US006105508A

United States Patent [19]

Ryburg

[11] Patent Number: 6,105,508

[45] **Date of Patent: *Aug. 22, 2000**

[54] WORK SURFACE FOR LUGGAGE AND LUGGAGE CARRIERS

[76] Inventor: Jon B. Ryburg, 566 Landings Blvd., Ann Arbor, Mich. 48103

[ * ] Notice: This patent issued on a continued prosecution application filed under 37 CFR 1.53(d), and is subject to the twenty year patent term provisions of 35 U.S.C. 154(a)(2).

[21] Appl. No.: 08/970,400

[22] Filed: Nov. 14, 1997

Related U.S. Application Data

[60] Provisional application No. 60/031,147, Nov. 19, 1996.

[51] Int. Cl.[7] ..... A47B 23/00

[52] U.S. Cl. ..... 108/42; 108/48

[58] Field of Search ..... 108/150, 42, 48; 280/30; 248/161, 157; 206/216; 190/11, 12 A, 15.1

[56] References Cited

U.S. PATENT DOCUMENTS

| | | | |
|---|---|---|---|
| 1,265,516 | 5/1918 | Reck | 108/150 X |
| 2,568,534 | 9/1951 | Baker | 108/150 X |
| 2,791,476 | 5/1957 | Atwill | 108/48 X |
| 2,867,484 | 1/1959 | Jennings | 108/48 X |
| 3,467,033 | 9/1969 | Sienkiewicz et al. | 108/150 |
| 5,329,860 | 7/1994 | Mattesky | 108/48 |
| 5,337,682 | 8/1994 | Wiseman | 108/94 |
| 5,411,192 | 5/1995 | Xiao | 108/48 X |
| 5,437,367 | 8/1995 | Martin . | |
| 5,528,993 | 6/1996 | Vincelli | 108/42 X |
| 5,529,322 | 6/1996 | Barton . | |
| 5,606,918 | 3/1997 | Cauffiel | 108/49 X |
| 5,615,620 | 4/1997 | Owen | 108/49 X |

*Primary Examiner*—Jose V. Chen

*Attorney, Agent, or Firm*—Harness, Dickey & Pierce, P.L.C.

[57] ABSTRACT

A portable work surface for use with a luggage carrier including, a work surface, a leg assembly operably coupled to the work surface and an engaging apparatus coupled to the work surface, where the luggage carrier includes at least one support member having a handle and where the engaging apparatus frictionally couples to the support member.

21 Claims, 6 Drawing Sheets

WORK SURFACE FOR LUGGAGE AND LUGGAGE CARRIERS

This application claims benefit of Provisional Appl. 60/031,147 filed Nov. 19, 1996.

BACKGROUND OF THE INVENTION

The present invention relates generally to portable secretaries and more particularly to a work surface which attaches to a luggage carrier, enabling a traveler to establish a portable office while waiting in airport terminals and the like. Several contemporaneous trends are pointing to the need for mobile amenities usually relegated to established or stationary office environments. An increasing number of business people rely on travel in their jobs because of air travel and enhanced airport security. Such individuals often find themselves spending a considerable amount of time in public places waiting for departures or arrivals. Concurrently, computing machinery has become increasingly portable with notebook computers and laptops equipped with sufficient hard disk and CD-ROM storage to carry sophisticated application programs and enormous files with work related information. Indeed, terms such as "mobile computing" and "nomadic computing" are becoming more prevalent.

Additionally for the sake of convenience, an increasing number of air travelers are resorting to carry-on luggage, as opposed to checked luggage, to avoid loss in transit and circumvent delays associated with baggage claim. Due to the increase in carry-on luggage, more individuals are using rolling carts and other structural mechanisms to assist in transferring bags from one place to the next, removing the need to lift and carry these cumbersome items. As a result, it is more and more common to see frequent fliers with "roll-a-board" type luggage carriers and other transport systems having wheels and extensible arms equipped with handles.

SUMMARY OF THE INVENTION

This invention addresses such trends by providing a portable work surface that may be secured to all types of luggage carriers. Such a work surface provided by the invention is not only preferably universal in its coupling to existing luggage carriers, but is substantial and stable enough to support two ½×11 documents side-by-side or a laptop computer. In alternate embodiments of the present invention the work surface will provide additional space for other devices such as a mouse or notepad.

In a first preferred embodiment, the work surface attaches to the vertical extensible handle support members common to a wide variety of wheeled luggage carriers by grasping or frictionally engaging the outer surfaces of the handle support members. As such, the invention may be universally applied to existing handle structures, whether formed of a single or a plurality of extensible handle support members. In this first embodiment of the present invention, the rear portion of the work surface includes a pair of rotating cams and a pair of uprights covered with a resilient frictional compressible material. The extensible handle support member(s) of a piece of luggage are placed between the cams and the uprights of the present invention. The work surface is frictionally secured onto the extensible handle support member(s) by rotating the cams until they pinch or constrain the handle support member(s) against the uprights. The height of the work surface may be varied depending on whether the user is in a seated or standing position. The front of the work surface is supported by a collapsible rod assembly which varies in length according to the position of the work surface. The rod assembly in conjunction with the engaged cams and uprights creates a stable tripod arrangement to support the work surface. The rod assembly is positioned between the legs of a user so that in a seated position the legs of the user will fit underneath the work surface allowing easy access to the work surface.

In a second embodiment of the present invention, the rearward portion of the work surface includes a pair of diagonally offset horizontal bars covered with a resilient frictional compressible material. The horizontal bars are placed on either side of the extensible handle support member(s) and the work surface is frictionally secured onto the extensible arm support member(s) by placing a slight downward pressure on the work surface. Such pressure is preferably applied in this embodiment through a strap or a leg, both such techniques being further defined below. The choice between using a strap or leg is dependent upon a number of factors, such as the depth of the base of the wheeled luggage unit itself and the dimensions of the chosen work surface. In alternate embodiments, positive clamping mechanisms may be used to grasp the luggage carrier extensible handle support member(s) on both sides, between front and back, or any combination thereof.

DETAILED DESCRIPTION OF THE PREFERRED EMBODIMENT

Figure 1:
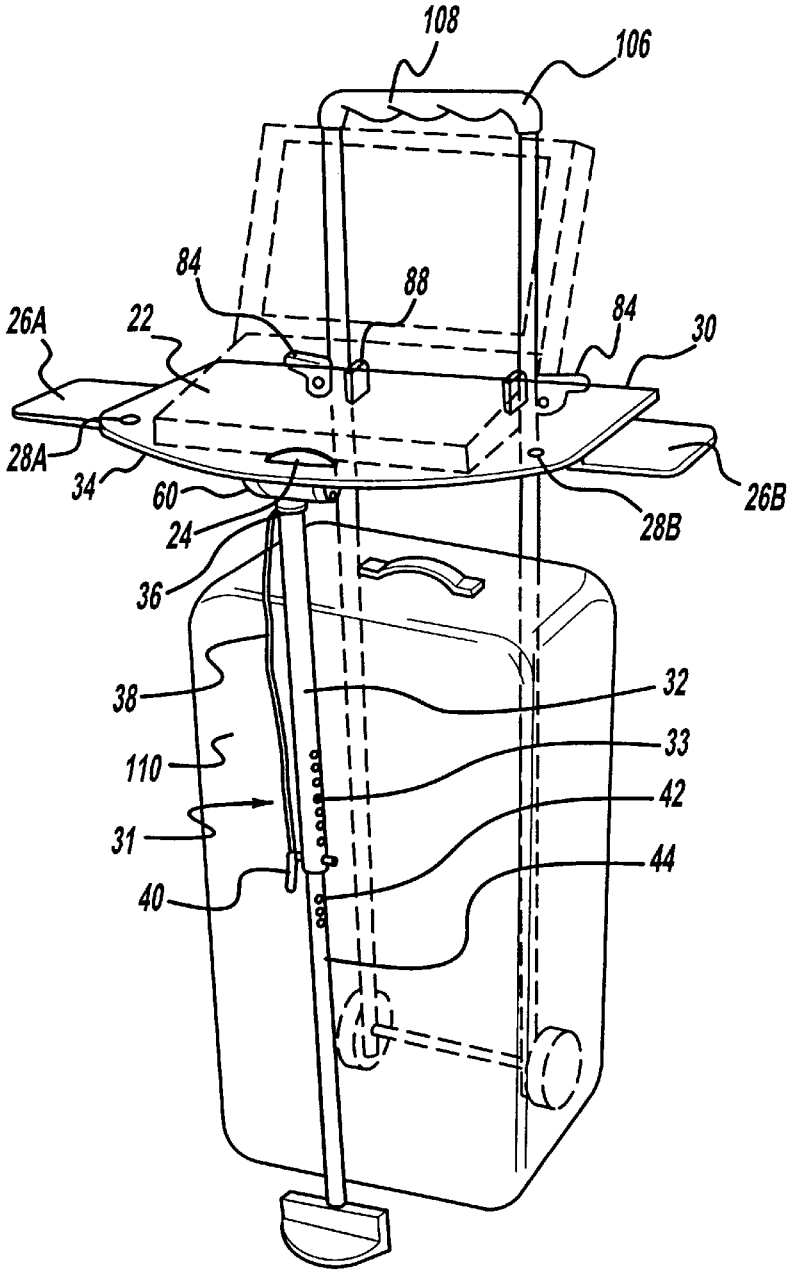
FIG. 1 is a perspective view of the first embodiment of the present invention.

FIG. 1 is a perspective view of the first embodiment of the present invention. The first embodiment includes a work surface 22 which engages with one or more vertical extensible handle support members 106, forming part of an assembly which connects a handle portion 108 to luggage 1 10 through an engaging means comprised of cams 84 and uprights 88. Although in this figure two vertical extensible handle support members 106 are shown, more or fewer may be present. The work surface 22 may be positioned in any manner upon the luggage carrier that allows the engaging means to couple with the vertical extensible handle support members 106. It should also be noted that the various dimensions depicted in FIG. 1, including the size of work surface 22, may be varied according to the circumstances and still remain within the spirit and scope of this invention.

The work surface 22 is generally a flat sheet cut or formed to the depicted shape, although other similar shapes may be used with the same general result. The work surface 22 provides the area from which a laptop computer or other office device may be placed in order to provide a suitable work platform. In the preferred embodiment the work surface 22 is provided in the form of a hardwood-surfaced plywood having a thickness of ¼", but a variety of other dimensions and materials may be used. The alternate materials include various woods, plastics, metals, composites, and combination of these materials. Alternate embodiments of the work surface 22 include hinged configurations which allow the work surface 22 to be folded or collapsed into a more portable form.

As shown in FIG. 1, the work surface 22 includes a stop 24 mounted to its top surface, providing a stable point of contact for a laptop computer or other office equipment. The work surface 22 is also pivotally coupled to auxiliary work surfaces 26A and 26B by pivots 28A and 28B. Auxiliary work surfaces 26A and 26B are normally located underneath work surface 22 but may be swiveled from underneath work surface 22 to an extended position with relation to work surface 22. Work surfaces 26A and 26B provide additional surface area for assorted office implements such as a computer mouse or files.

Work surface 22 is frictionally coupled to the vertical extensible handle support members 106 attached to luggage 110 by a pair of rotating cams 84 and a pair of uprights 88. Rotating cams 84 and uprights 88 are coupled to the back end 30 of work surface 22 and create a stable foundation from which to further erect the present invention. An additional support structure shown in FIG. 1 as rod assembly 31 is operably coupled to the front of work surface 34. The rod assembly includes a support member 60 operably coupled to said work surface 22 and further coupled to support rod 32 having apertures 33. An adjustment pin 40 is elastically coupled to support rod 32 by elastic cord 38 and coupling means 36. The coupling means 44 may be a circular elastic band or other device which prevents the loss of the adjustment pin 40. The elastic cord 38 is designed to allow maximum freedom of movement for the adjustment pin 40 while minimizing its slack. The adjustment pin 40 rigidly joins support rod 32 to support rod 44 having apertures 42 by penetrating apertures 33 and 42. Support rod 44 is coupled to upright member 46 which is further coupled to foot 48, creating a structure which supports work surface 22 on it front end 34. This first embodiment of the rod assembly 31 may be adjusted to fit the height of any luggage by operably sliding support rod 44 into support rod 32 in a telescopic fashion until the desired elevation is reached. The adjusting pin 40 then fixes the relative position of support rods 44 and 32 to create a rigid structure from which the working surface 22 may rest on.

Figure 1A:
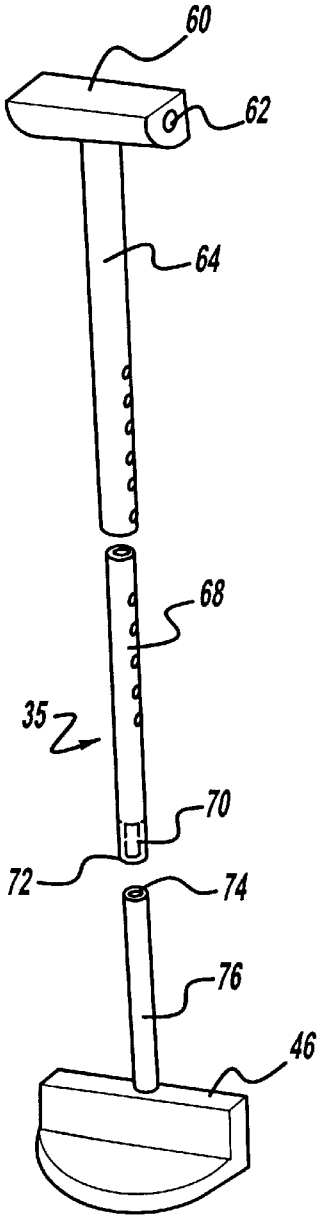
FIG. 1A is a perspective view of a second embodiment of the rod assembly.

A second embodiment of the rod assembly 35 is shown in FIG. 1A. This second embodiment includes support member 60 and support rods 64 and 68 having apertures which may be coupled in the same manner as the first embodiment. This embodiment of the present invention also includes a third support rod 76 having threaded aperture 74 located in its top surface. Threaded aperture 74 couples support rod 68 to support rod 76 by a threaded member 70 located in recess 72. Support rod 76 is placed into recess 72 until threaded member 70 slightly penetrates threaded aperture 74. Support rod 76 is then rotated, with reference to support rod 68, until threaded member 70 and threaded aperture 74 are fully engaged, creating a rigid structure from which the work surface 22 may rest upon as in the first embodiment. This second embodiment of the rod assembly 35 allows flexibility in its break down and reduces the overall length of the separate support rods so that they may be better stored under smaller dimensioned work surfaces 22.

Figure 2:
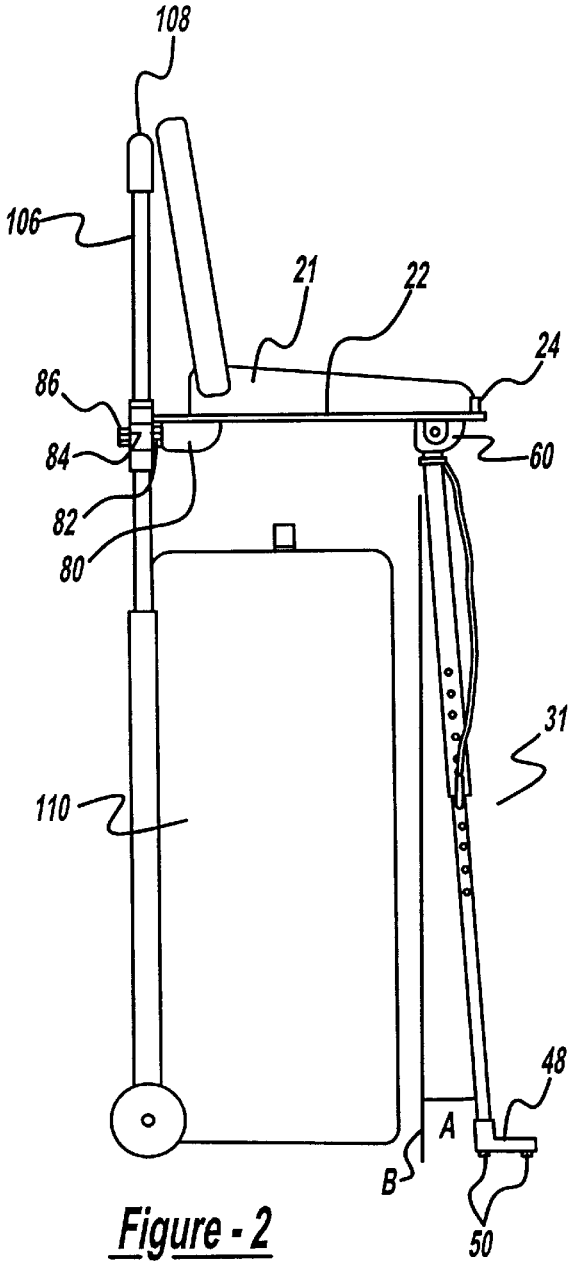
FIG. 2 is a side elevation view of the first embodiment of the present invention.

FIG. 2 is a side elevational view of the first embodiment of the present invention illustrating its operation. Rotating cams 84 are coupled to bushings 82 and bracket 80 by fasteners 86 which penetrates cams 84, bushings 82 and bracket 80 in a fashion which allows the rotation of cams 84. Vertical extensible handle support members 106 of luggage 110 are placed between rotating cams 84 and uprights 88 at the desired height, and cams 84 are rotated until they pinch or constrain the vertical extensible handle support members 106 against the uprights 88. Uprights 88 are covered with a resilient frictional compressible material such that they better grip the vertical extensible handle support members 106 and prevent slippage. In another embodiment cams 84 have been formed with a concave surface to better engage with the generally cylindrical shape of the handle support members 106.

As shown in FIG. 2, rod assembly 31 is further assembled to the desired vertical height and rotated so that angle A measured from vertical line B is approximately 15 degrees. As rod assembly 31 rotates about pivot point 62, it will come to a stop when the top surface of support member 60 contacts the underside of the work surface 22, creating a rigid foundation for supporting the front 34 of work surface 22. Upon completion of the rotation, angle A is approximately 15 degrees and foot 48 is in contact with the ground through points 50. In one embodiment of the present invention there are three points 50 spaced in a triangular manner on the bottom of foot 48 to create a tripod arrangement. When the rod assembly 31 is assembled in the manner as detailed above, the three points 50 will contact the floor simultaneously, creating a sturdy tripod base which braces the rod assembly 31. Laptop 21 can then be placed and operated upon the finished structure with confidence in the steadiness of the work surface 22. A person skilled in the art would recognize that the base may be configured in numerous permutations that would not depart from the spirit and scope of the disclosed invention.

Figure 3:
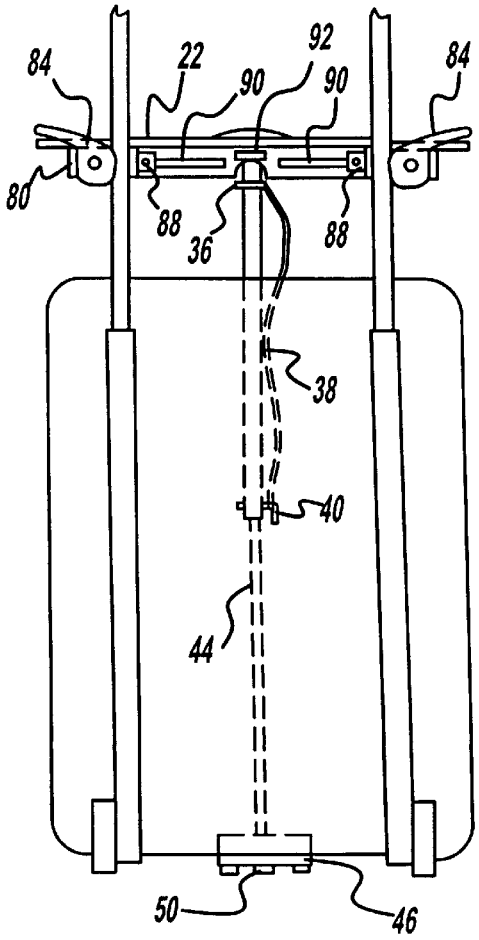
FIG. 3 is a rear elevation view of the first embodiment of the present invention.

FIG. 3 is a rear elevational view of the first embodiment of the present invention. Bracket 80 is coupled to the underside of work surface 22 and its internal edges define slots 90 which are operably coupled to cams 84 and uprights 88. Cams 84 and uprights 88 may be moved along slot 90, varying their relative spacing, to accept any luggage handle configuration. Once cams 84 and uprights 88 are positioned in the desired manner they are locked in position with a securing means. In one embodiment of the present invention, the securing means is a fastener assembly 79 comprised of threaded fasteners 86 disposed through a bore in cams 84 and uprights 88, further disposed through slot 90, and coupled to threaded nuts 85 which are tightened to secure cams 84 and uprights 88. Washers with a coarse surface may be used in addition to the threaded nuts 85 and threaded fasteners 86 to help secure the cams 84 and uprights 88 against bracket 80. The coarse surface of the washers will increase friction against bracket 80 to help prevent the movement of cams 84 and uprights 88.

Figure 4:
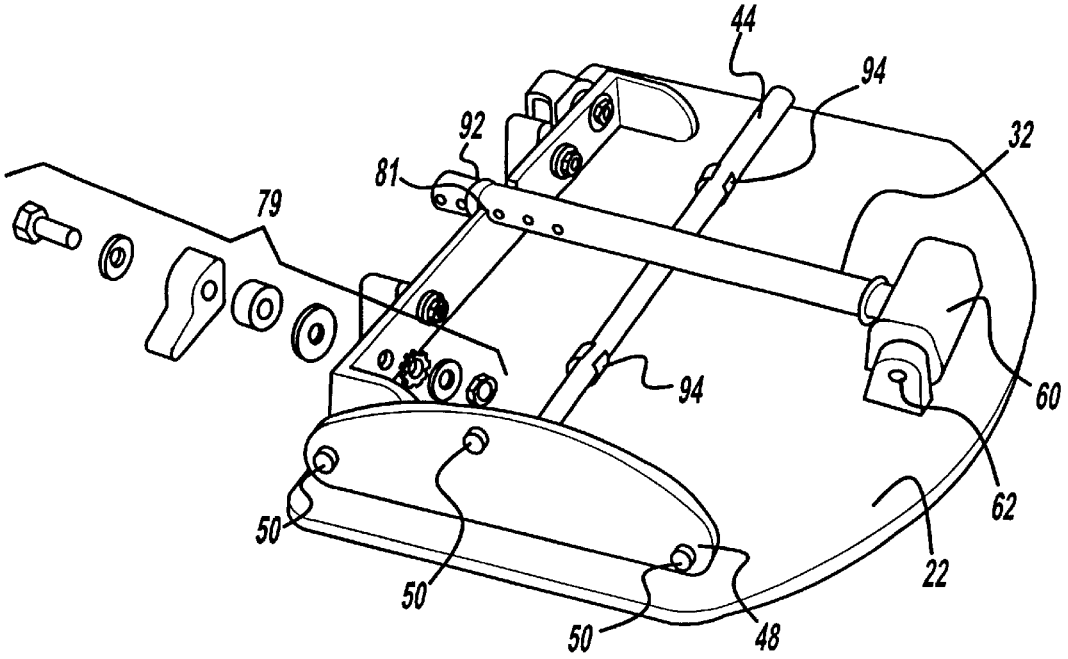
FIG. 4 is a bottom perspective view of the first embodiment of the present invention in a collapsed state.

FIG. 4 is a perspective bottom view of the first embodiment of the present invention in a collapsed state. The present invention when not being used must be reduced to a small volume in order to be convenient and portable. The rod assembly 31 is collapsed by removing pin 40 and disengaging support rods 32 and 44. Support rod 32 may be rotated around pivot assembly 62 until it reaches a fully collapsed position under work surface 22. Bracket 80 has external edges which define a generally semicircular cut-out 81 in which the end of support rod 32 may be placed in and then restrained with elastic band 92. Support rod 44 is then coupled to grips 94 underneath work surface 22 in a manner that positions foot 48 within the perimeter of work surface 22. In other embodiments, which include a rod assembly composed of three or more rod supports, extra grips are added to secure the additional rods within the perimeter of work surface 22. The grips 94 may be constructed from Velcro, hooks, clamp, clasps, or other securing devices.

Figure 5:
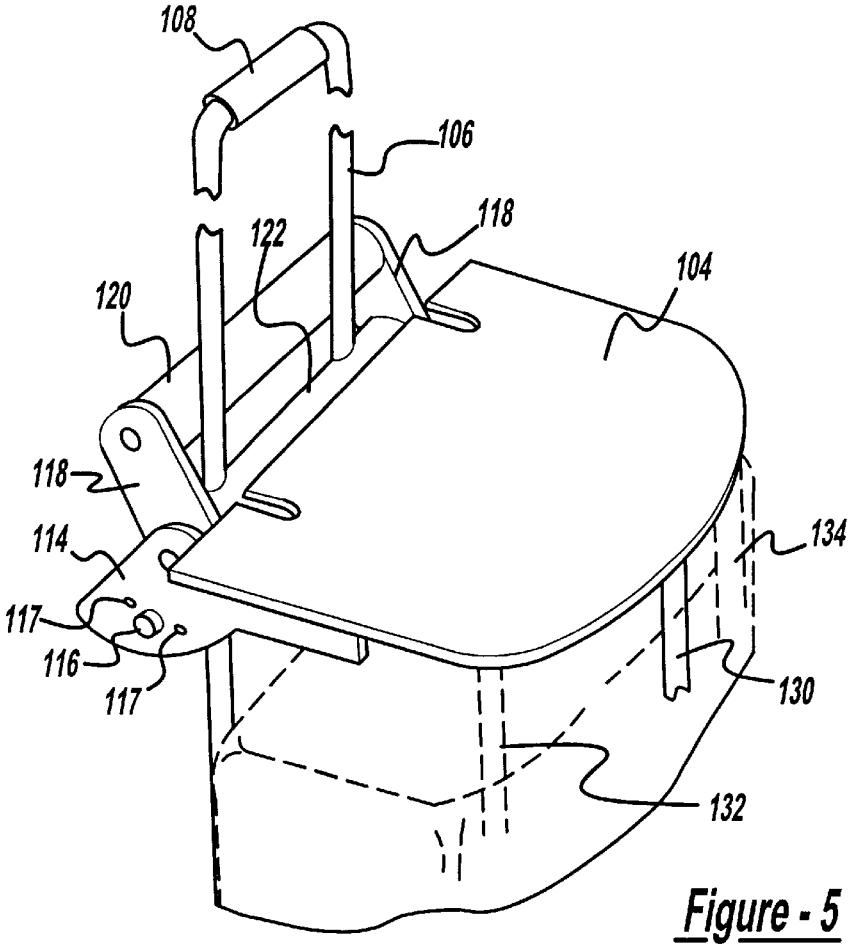
FIG. 5 is a perspective view of the second embodiment of the present invention.

In a second embodiment of the present invention illustrating a second engaging means shown in FIG. 5, a pair of side support members 114 (only one of the support members 114 is visible) are adhered transversely to the bottom of a work surface 104 similar to the work surface of the first embodiment. These side support members 114 are pivotally attached to members 118 which support horizontal members 120 and 122. Horizontal members 120 and 122 straddle the vertical extensible handle support members 106 in diagonal fashion as shown in FIG. 5. Preferably, horizontal members 120 and 122 are fashioned from rigid rods of wood or other suitable light weight materials such as a tubular metal, polymer or composite. To enhance the frictional gripping between the horizontal members 120 and extensible handle support members 106, the horizontal members 120 are preferably coated or covered with a resilient compressible and non-skid or "grabby" material such as natural latex rubber or other suitable polymeric alternatives. With the horizontal members 120 and 122 placed over the handle as shown, a downward force is applied to the work surface 104. Horizontal member 122 is biased against the forward sections of the extensible handle support members 106, while horizontal member 120 is biased against the back surfaces of the extensible handle support members 106. A secure frictional pinching or compression engagement will take place between the horizontal members 120 and 122 and the extensible handle support members 106.

A pair of pins 116 on both sides of this second embodiment (only one of the pins is visible in FIG. 5) permit adjustment of the front-to-back distance or vertical opening between the two parallel members 120 and 122 so that the resulting assembly may readily fit over various thicknesses of vertical extensible handle support members 106 associated with a wide variety of luggage units. Although such thicknesses for currently available units is in the range of ⅜"–¾", the flexibility of the invention enables it to accommodate a much wider range.

Figure 6:
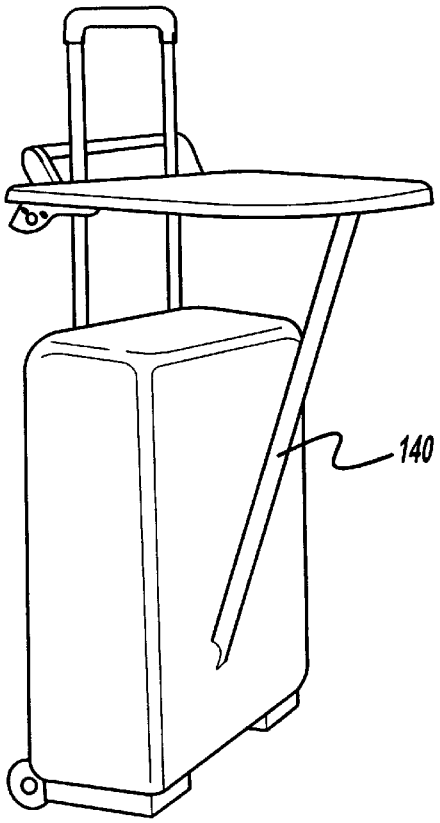
FIG. 6 is a perspective view of the second embodiment of the present invention utilizing a strap connection.

As mentioned previously, the work surface 104 of the second embodiment of the invention is frictionally secured on the vertical extensible handle support members 106 of the luggage carrier by placing slight downward pressure on the work surface 104. Preferably, such downward pressure may be applied through one or more straps 140, or through an extensible leg 150 with a base unit 160 adapted for accommodation beneath the luggage or carrier components as shown in FIGS. 6 and 7.

The choice of which pressure-applying mechanisms is most appropriate depends upon several key variables, including the base depth of the wheeled luggage unit. For example, the strap 140 option should be used when the front-to-back depth of the wheeled luggage unit is 10 inches or greater with the force on the work surface 104 not exceeding 20 pounds, and/or when the lateral forces experienced by the work surface 104 are not excessive during use. The leg 150 should be used when the front-to-back depth of the wheeled luggage unit is less than 10 inches, when the load on the work surface 104 exceeds 20 pounds or whenever the usage of the work surface 104 is subject to particularly vigorous side-to-side or front-to-back forces.

As shown in FIG. 5, a strap 140 or leg 150 is preferably placed at position 130, though other positions 132 and 134 may be used instead of, or in conjunction with, the placement at 130. The strap 140 material is preferably of a nonelastic variety and includes an adjustment device enabling one of its ends to be removably connected to the front underside of the work surface 104. The other end of the strap 140 is then anchored to some point on the luggage or frame below the luggage via any appropriate means such as hooks, buckles or Velcro as shown in FIG. 6. When the strap 140 is shortened by the adjustment device, the strap 140 will be in tension and will pull the work surface 104 slightly. This tensioning will frictionally engage the horizontal members 120 to the extensible handle support members 106 as previously described. Disengagement of the strap 140 at either end or significantly loosening the adjustment device will release the work surface 104. The work surface 104 will then spring slightly upward to a level position for storage or to reposition the work surface 104 at a more convenient level on the handle support members 106.

Figure 7:
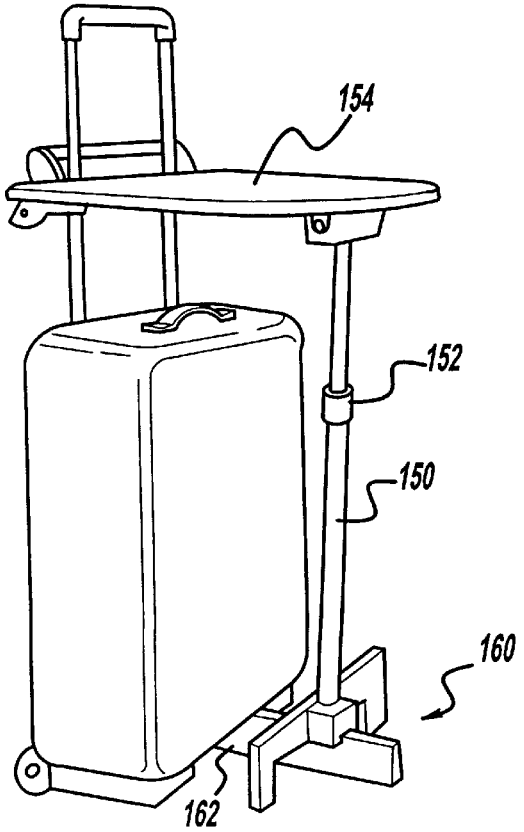
FIG. 7 is a perspective view of the second embodiment of the present invention utilizing a leg support.

FIG. 7 is a perspective view of the second embodiment of the present invention illustrating the leg 150 and base unit 160. The bottom end of the leg 150 is coupled to the base unit 160. The objective of the leg 150 is to generate sufficient downward pressure on the work surface 154 to frictionally lock it into position, while also stabilizing the entire unit. The leg 150 is preferably a two-piece construction including a manually operable tightening/loosening portion such as textured ring 152, enabling the length of the leg 150 to be adjusted in a telescopic fashion. Other adjustment means such as the adjustment pin 40 described in a previous embodiment may also be used to vary the length of leg 150.

Making particular reference to FIG. 7, the leg 150 includes an upper portion which is removably and preferably hinged to the front underside surface of the work surface 154. As previously described, the bottom portion of the leg 150 includes an outer tube which transitions into a base unit 160 that rests on the floor. The base unit 160 preferably includes a member 162 which fits under the front edge of the luggage or frame at floor level. With the element 152 in a loosened state, the upper portion of the leg assembly may be shortened, causing the work surface 154 to be pulled slightly downward. This shortening frictionally secures the work surface 154 to the extensible handle support members 106 as previously described, at which point the device 152 may be tightened to hold the resulting configuration in place.

FIG. 7 further illustrates that base unit 160 may take the form of an assembly having crisscross members which may be folded relative to one another for a more compact storage capability. In the preferred embodiment, the assembly may be provided with locking means to ensure that after unfolding, the members remain in a locked position. A pin may be laterally inserted through adjustment holes in both like pieces to provide this locking function. When the base is locked and fitted underneath the luggage/frame at the floor, and with the length of the leg adjusted to apply sufficient downward pressure on the work surface 154, the overall structure assumes a very stable configuration.

Figure 8:
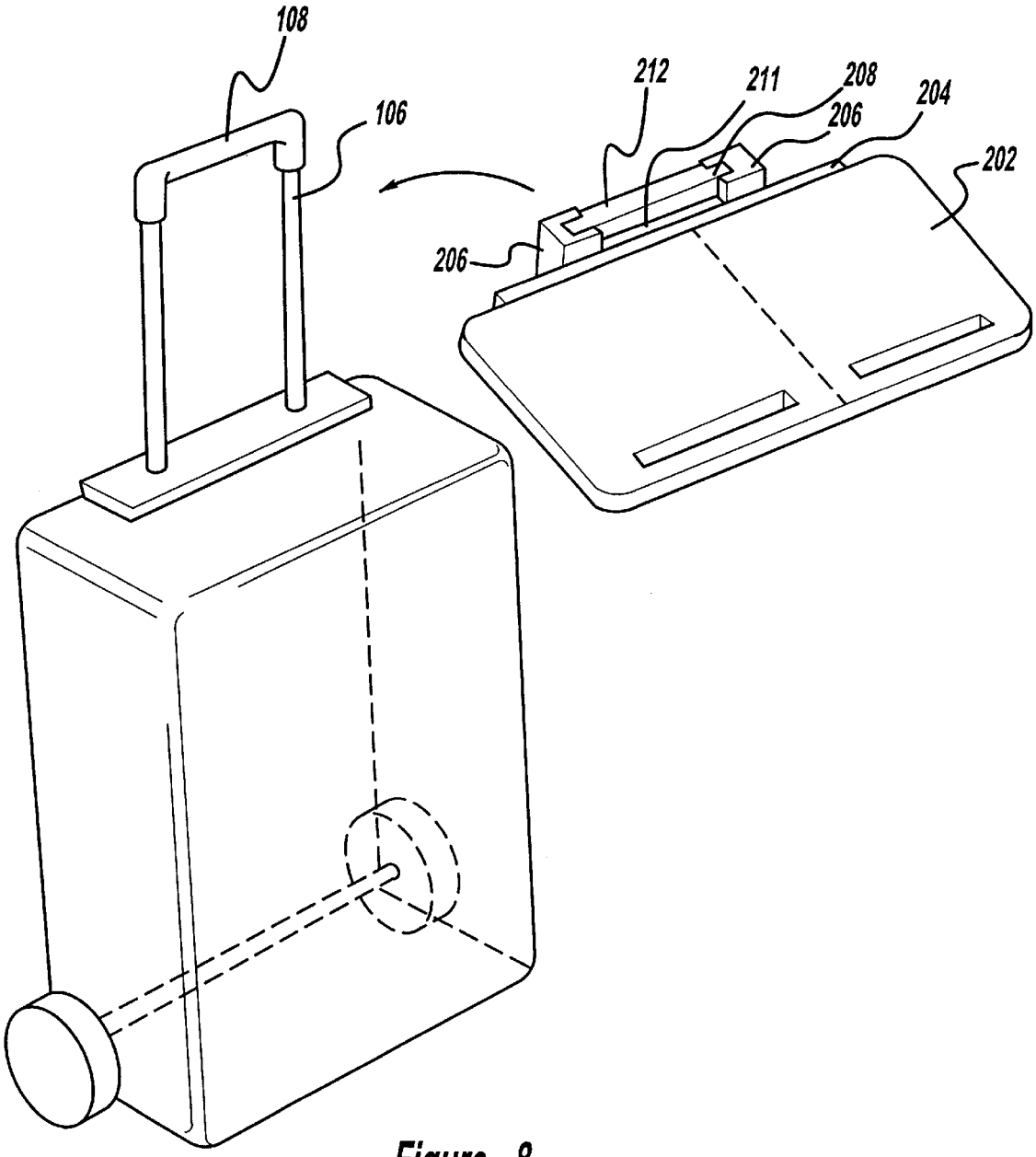
FIG. 8 is a perspective of the third embodiment of the present invention.

FIG. 8 is an oblique perspective of a third embodiment of the present invention where the luggage extensible handle support members 106 are grasped from their exterior sides 210. In this embodiment, a work surface 202 includes a rear edge having a track 204 into which opposing rigid bodies 206 slidingly engage. These rigid bodies each have contoured sections 208 facing towards one another. These contour section 208 are generally cylindrical in cross section and preferably include compressible resilient pads that grip the extensible handle support members 106 on their exterior sides 210. These compressible resilient pads slip over the extensible handle support members 106 when the rigid bodies 206 are pulled apart. This simple pulling action aids in level adjustment and the removal of the work surface 202.

To bias the bodies 206 toward one another, different tensioning mechanisms may be used, such as a pair of elastic bands 211 and 212. As an alternative, springs may be used, a choice in tensioning mechanisms depends upon the way in which bodies 206 slidingly engage with track 204. The additional rearward biasing element such as elastic band 212 may be omitted if the engagement between the bodies 206 and the track 204 is sufficiently controlled. In this case the user need only pull the two bodies 206 apart and place the assembly onto the extensible handle support members 106 of the handle assembly. If a rearward elastic band such as 212 were to be used, the assembly would have to be brought down over the top of the handle assembly.

Figure 9:
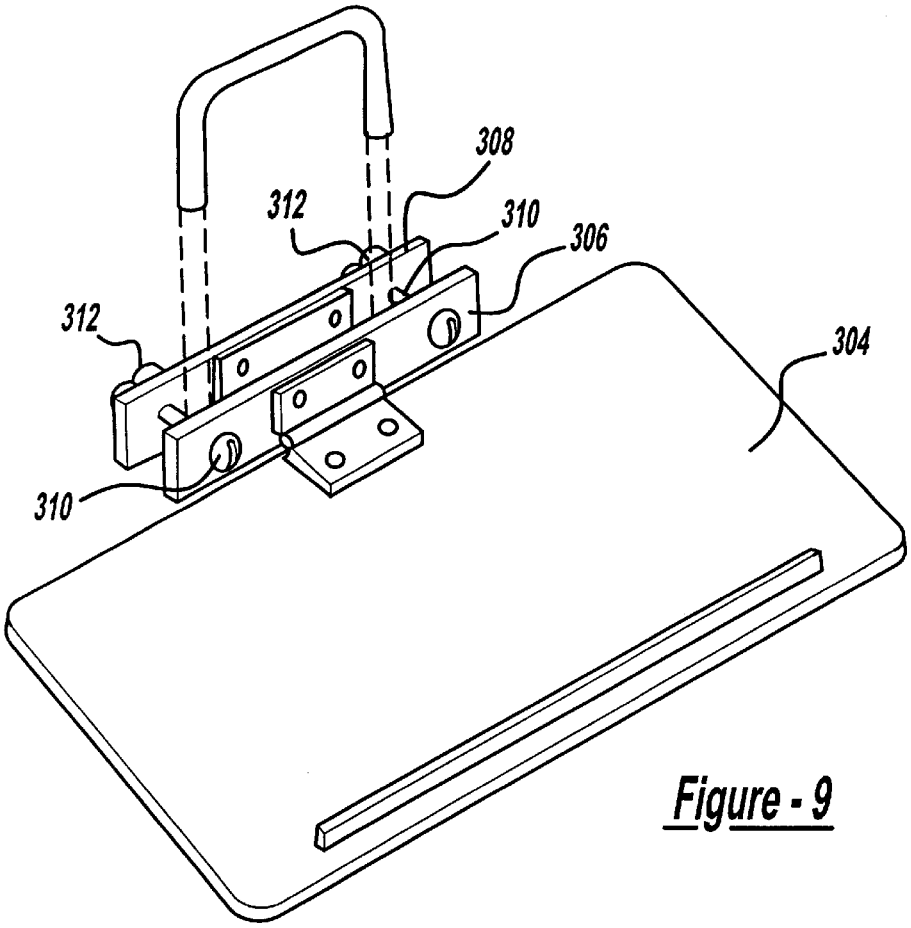
FIG. 9 is a perspective of the fourth embodiment of the present invention.

FIG. 9 illustrates a fourth embodiment of the present invention where the vertical extensible handle support members 106 are grasped by an engaging means from the front and back. This fourth embodiment executes this capability with first and second clamping members, 306 and 308, which are respectively brought together and apart through use of a pair of manually adjustable fasteners in the form of bolts 310 coupling to wing nuts 312. It will be apparent to one skilled in the art that other types of clamping mechanisms may alternatively be used, including cams and levers facilitating quicker and more forceful engagement and/or release.

Although the shaft of fasteners 310 may be positioned more closely toward one another, in the preferred embodiment, they are sufficiently spaced apart so as to be on the outside of the handle assembly. In this manner this embodiment of the invention is also applicable to luggage carrier handle assemblies having one piece extensible handle support members as well as those having a plurality of extensible handle support members. Attached to the forward clamping member 306 is a work surface 304 which in the preferred embodiment is hingedly affixed to the member 306. This facilitates an adjustment of tilt angle relative to a user. Once adjusted, the surface 304 may be locked into place at a particular tilt angle using a variety of mechanisms, including the use of rod assemblies and legs discussed in previous embodiments.

Figure 10:
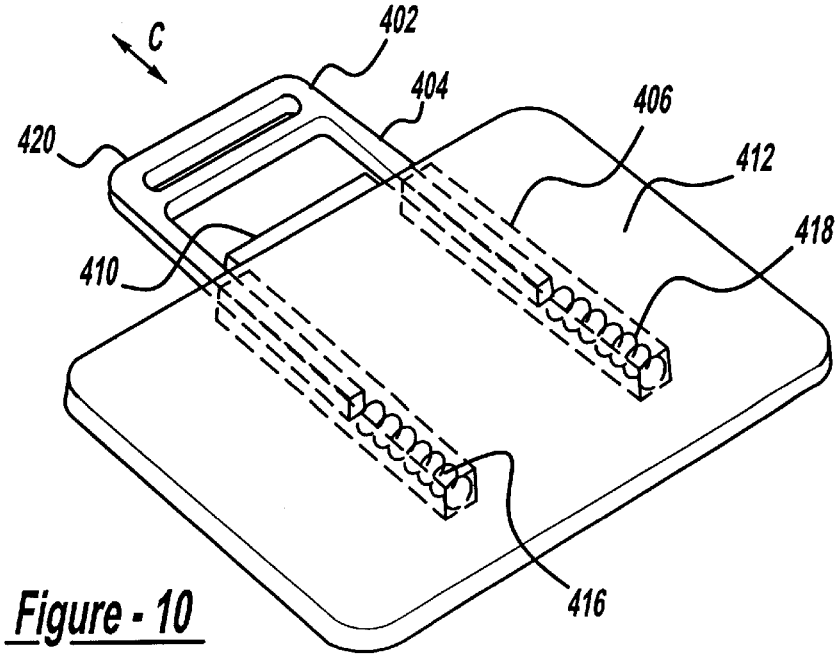
FIG. 10 is a perspective of the fifth embodiment of the present invention.

Reference is now made to FIG. 10, which shows a front-to-back clamping arrangement in the spirit of the fourth embodiment. In this fifth embodiment, a spring loaded clamping mechanism is used to engage the present invention with the vertical extensible handle support members 106 of a luggage carrier. A U-shaped member 402 includes two parallel ends 404 which are guided by tracks 406 and spring-loaded to bias a rearward member 408 toward a rearward edge 410 of a work surface 412. In the present embodiment a pair of springs 416 and 418 are utilized to provide bias loading. A handle 420 is also preferably provided to the rearwardmost aspect of the member 402 to facilitate a more convenient operation described below.

To install the apparatus of FIG. 10, a user simply uses one hand to grasp the work surface 412 proper and employs the other hand to bias the rearward member 408 and rearward edge 410 of the work surface 412 in the directions of arrow C. This biasing creates a space between rearward member 408 and edge 410 that is sufficiently large to be placed over the luggage carrier handle assembly. When the work surface 412 is set at a desirable height, the user may reduce force on the handle to allow the rearward member 408 to move toward the rearward edge 410. The bias of the springs 416 and 418 will grasp the front and back portions of the extensible handle support members 106 of the luggage carrier. As in the case of other embodiments described herein, the surfaces associated with the grasping of the handle assembly may be provided with a frictional compressible material such as rubber to enhance the frictional engagement.

It is to be understood that the invention is not limited to the exact construction illustrated and described above, but that various changes and modifications may be made without departing from the spirit and scope of the invention as defined in the following claims.

I claim:

1. A portable work surface comprising:

a luggage carrier having at least one handle support member;

a work surface including an engaging means coupled to said work surface, said engaging means coupling said work surface to said handle support member; and a rod assembly operably coupled to said work surface.

2. The portable work surface of claim 1 further comprising at least one auxiliary work surface pivotally coupled with said work surface, wherein said auxiliary work surface may be swiveled underneath said work surface for storage.

3. The portable work surface of claim 1 wherein said rod assembly comprises:

a support member operably coupled to said work surface;

a plurality of support rods wherein one of said support rods is coupled to said support member;

an upright member coupled to one of said support rods;

a foot coupled to said upright member; and wherein said plurality of support rods may be adjusted to assume multiple lengths.

4. The portable work surface of claim 3 wherein said foot includes a plurality of points which contact a supporting surface to create a stable footing.

5. The portable work surface of claim 3 wherein said plurality of support rods comprise:

two support rods having apertures; and an adjustment pin that penetrates said apertures to join said two support rods in a rigid structure.

6. The portable work surface of claim 3 wherein said plurality of support rods comprise:

a first support rod having apertures, wherein said first support rod is operably coupled to said support member;

a second support rod having apertures and a threaded member, wherein said second support rod is rigidly coupled to said first support rod by an adjustment pin penetrating said apertures in said first and second support rods; and a third support rod having a threaded aperture defined in its top surface that threadingly engages with said threaded member.

7. The portable work surface of claim 3 wherein at least one of said support rods is pivotally coupled to said work surface so that it may be pivoted underneath said work surface to be secured and any remaining said support rods may be placed in grips to be secured, whereby said portable work surface may be broken down into a compact form.

8. The portable work surface of claim 1 wherein said rod assembly is pivotally connected to said work surface and wherein said rod assembly is rotated to an angle with respect to vertical and said foot contacts a supporting surface.

9. The portable work surface of claim 1 wherein said engaging means comprises:

a rotating cam; and an upright, wherein said handle support member is placed between said rotating cam and said upright, and said rotating cam is rotated until it constrains said handle support member against said upright, whereby said work surface is rigidly coupled to said handle support member.

10. The portable work surface of claim 9 wherein said rotating cam has a concave surface to better engage said handle support member.

11. The portable work surface of claim 9 wherein said upright has a frictionally gripping surface.

12. The portable work surface of claim 1 wherein said engaging means comprises:

a plurality of side support members;

a plurality of pivoting members pivotally attached to said side support members; and a plurality of horizontal members supported by said plurality of pivoting members wherein said horizontal members straddle said handle support member, wherein a downward force is applied to said work surface that biases said horizontal members against said handle support member such that said horizontal members are frictionally coupled to said handle support member.

13. The portable work surface of claim 12 wherein said horizontal members are coated with a frictional gripping material.

14. The portable work surface of claim 12 wherein said downward force is applied by a leg.

15. The portable work surface of claim 14 wherein said leg is coupled to a collapsible base.

16. The portable work surface of claim 12 wherein said downward force is applied by a strap coupled to said luggage carrier.

17. The portable work surface of claim 1 wherein said engaging means comprises:

a track;

opposing rigid bodies elastically biased towards each other and slidingly engaged to said track; and compressible pads coupled to said rigid bodies, wherein said rigid bodies are pulled apart and slipped over said handle support member and then allowed to bias against the exterior sides of said handle support member creating a rigid coupling between said rigid bodies and said handle support member.

18. The portable work surface of claim 1 wherein said engaging means comprises:

a plurality of clamping members; and a plurality of manually adjustable fasteners which tighten said clamping members against said handle support member.

19. The portable work surface of claim 1 wherein said engaging means comprises:

a spring loaded clamping mechanism; and a U-shaped member operably coupled to said spring loaded clamping mechanism, wherein said U-shaped member is pulled away from said work surface, slipped over said handle support member and then allowed to bias against the exterior sides of said handle support member creating a rigid coupling between said U-shaped member and said handle support member.

20. A portable work surface comprising:

a luggage carrier having extensible support members;

a work surface having an underside, said work surface coupled to said luggage carrier with a frictional engagement means;

a collapsible rod assembly coupled to said work surface wherein said collapsible rod assembly can be broken down into a plurality of support rods and wherein at least one of said support rods is pivotable about said underside of said work surface to assume a storage position and the remaining support rods are coupled to said underside of said work surface, whereby said portable work surface assumes a compact shape for packing and movement;

a base coupled to said collapsible rod assembly that contacts a flat surface through a plurality of points to create a stable structure to support the front of said work surface; and wherein said work surface may be raised or lowered upon said extensible support members and said collapsible rod assembly may be varied in length to move said work surface to the desired elevation.

21. A portable work surface comprising:

a luggage carrier having at least one handle support member;

a work surface including an engaging apparatus coupled to said portable work surface, wherein said engaging apparatus frictionally couples to said handle support member;

a rod assembly operably coupled to said work surface;

a base coupled to said collapsible rod assembly that contacts a flat surface through a plurality of points to create a stable structure to support the front of said work surface.

* * * * *